US006402887B1

(12) United States Patent
Akhtar et al.

(10) Patent No.: US 6,402,887 B1
(45) Date of Patent: Jun. 11, 2002

(54) BIOPULPING INDUSTRIAL WOOD WASTE

(75) Inventors: Masood Akhtar, Madison, WI (US); Gary M. Scott, Syracuse, NY (US); Aziz Ahmed, Middleton, WI (US); Michael J. Lentz; Eric G. Horn, both of Madison, WI (US)

(73) Assignees: Biopulping International, Inc., Madison, WI (US); The United States of America as represented by the Secretary of Agriculture, Washington, DC (US)

( * ) Notice: Subject to any disclaimer, the term of this patent is extended or adjusted under 35 U.S.C. 154(b) by 0 days.

(21) Appl. No.: 09/201,612

(22) Filed: Nov. 30, 1998

Related U.S. Application Data

(60) Provisional application No. 60/067,478, filed on Dec. 1, 1997.

(51) Int. Cl.[7] ..... D21B 1/02

(52) U.S. Cl. ..... 162/13; 162/25; 162/72; 162/73; 162/91; 162/141

(58) Field of Search ..... 162/1, 4, 13, 91, 162/72, 141, 55, 147, 90, 150, 25, 189, 73

(56) References Cited

U.S. PATENT DOCUMENTS 1,138,907 A * 5/1915 Thickens ..... 162/90
1,873,056 A * 8/1932 Smith et al. ..... 162/141
2,528,350 A * 10/1950 Farbar ..... 162/91
5,055,159 A 10/1991 Blanchette et al.
5,460,697 A 10/1995 Akhtar et al.
5,620,564 A 4/1997 Akhtar
5,705,383 A * 1/1998 Blanchette et al. ..... 162/72

OTHER PUBLICATIONS

Akhtar et al., *Paper Age* (Feb. 1999).
Borralho, N.M.G. et al. *Breeding Objectives for Pulp Production of Eucalyptus Globulus Under Different Industrial Cost Structures. Can J. For.* (1992) 23:648–659.
Woodbridge, Reed and Associates. *World Market Pulp Demand with Special Reference to Eucalyptus. Canada Alberta* (1986).

* cited by examiner

*Primary Examiner*—Peter Chin
(74) *Attorney, Agent, or Firm*—Grady J. Frenchick; Karen B. King; Michael Best & Friedrich LLP

(57) ABSTRACT

A method using biological processes in the production of pulp from industrial wood waste is described. The process makes use of various species of white-rot fungi which selectively degrade lignin. The industrial wood waste must be cleaned and hydrated prior to inoculation with the fungus. Paper produced by this process has excellent strength characteristics as compared to both non-treated industrial wood waste and pulp produced from virgin wood chips. Substantial energy savings are also realized when the biopulped industrial wood waste chips are further refined by conventional mechanical pulping procedures. Kraft pulping of wood waste resulted in strength properties comparable to those of virgin wood. Fungal pretreatment subsequently enhanced the resulting kraft pulp properties.

13 Claims, No Drawings

BIOPULPING INDUSTRIAL WOOD WASTE

This application claims benefit to Ser. No. 60/067,478 filed Dec. 1, 1997.

FIELD OF THE INVENTION

The present invention relates to the field of paper manufacture, and in particular relates to paper production from industrial wood waste using a biomechanical or kraft pulping process.

BACKGROUND OF THE INVENTION

Preservation of forests and increasing environmental awareness have focused research on the development of alternative sources of wood fiber for paper making. Industrial wood waste is an unexploited source of material for paper making. Industrial wood waste includes kiln dried, air dried and green wood from industrial, residential, sawmill, construction and demolition sources. Millions of tons of industrial wood waste are produced in the United States each year. Currently, industrial wood waste is used for such applications as mulch cover, colored mulch, animal bedding, daily landfill and boiler fuel as described in Conrad, P., *BioCycle* 36:11, 70–72, 1995.

Many methods of making pulp from wood for producing paper are known. Wood is composed primarily of cellulose polymer fibers held together in fiber bundles by lignin. Cellulose is the most abundant polysaccharide in nature and is a linear polymer of repeating beta-D-glucopyranose units. Lignins are polymers of polyphenolic units. The lignin polymerization process results in the formation of randomly branched and cross-linked structures. Lignins can be broadly classified into two groups: Guaiacyl lignins which are largely present in conifers and guaiacyl-syringyl lignins which are found in all angiosperms.

The purpose of pulping is to separate the cellulose fibers from other wood components such as lignin. The degree of separation obtained is described as freeness. It is generally desirable to produce long, fibers with a high level of fibrillation. Increased fibrillation increases fiber strength due to increased fiber-fiber contact.

Pulping processes may be divided into three classes: mechanical, chemical, and hybrid systems. These different processes produce pulp with different fiber characteristics, which in turn results in paper having different characteristics. Because of the different characteristics of paper produced by mechanical and chemical processes, it is often advantageous to mix chemical and mechanical pulps to form a final product.

Mechanical pulping is an energy intensive process involving the use of mechanical force to separate wood fibers. Mechanical pulping processes generate heat from friction which acts to soften lignin and resins within the wood, resulting in the freeing of cellulose fibers. Mechanical pulping processes result in a high yield of usable fiber and paper with high bulk, good opacity, and excellent printability. However, the paper has relatively low strength and tendency to turn yellow over time. Examples of mechanical pulping include stone ground wood and refiner mechanical pulping where the wood is simply ground or abraded in water the during milling operation.

Chemical pulping processes result in hydrolysis of lignin polymer bonds, freeing the cellulose fibers. The paper produced by chemical pulping has high strength. However, chemical processes produce a low yield of fiber and require significant waste treatment. The main chemical processes used in the United States are kraft pulping and sulfite pulping. About 85% of the pulp in the United States is produced by kraft pulping. Kraft pulping is characterized by cooking wood chips in an alkaline cooking liquor containing NaOH and $Na_2S$.

Several hybrid pulping techniques exist which combine pulping techniques. Combined pulping techniques include thermomechanical pulping, chemirefinermechanical pulping and chemithermormechanical pulping. These processes have gained popularity because they require a lower capital investment and produce higher yields of pulp than standard chemical methods and produce stronger paper than mechanical methods.

The paper industry has recently entered the age of biotechnology with the development of methods for the use of various enzyme systems in production of pulp. For a review of the enzymology of pulping, see Enzymes for Pulp and Paper Processing, Jefferies and Viikari eds., American Chemical Society, Washington, D.C., 1997. The most successful use of enzymes in paper manufacture has been the use of hemicellulases such as xylanase for enzymatic prebleaching of kraft pulp. The enzymatic pre-treatment reduces the amount of chemicals needed to attain desired brightness. However, the paper industry has been slow to utilize some of the new enzyme technologies. One problem is that wood and pulp degrade slowly. Secondly, enzymes often require very specific conditions for activity making the degradation difficult to control in a mill.

One solution to these problems is to utilize a fungus containing desirable enzyme systems to selectively degrade wood. White-rot fungi have been successfully utilized in the production of pulp. For a review of biopulping, see Akhtar et al., Fungal Delignification and Biomechanical Pulping of Wood, in *Advances in Biochemical Engineering/Biotechnology,* T. Scheper ed., Springer-Verlag, Berlin, 1997. White-rot fungal hyphae enter the cell lumina of virgin wood and rapidly colonize the ray parenchyma cells which contain free sugars and other nutrients. The radial arrangement of the ray parenchyma facilitates hyphae access into the wood and allows widespread distribution of fungal hyphae in the wood. Once the free sugars and other nutrients are depleted, degradation of the cell wall proceeds because the fungus utilizes cell wall materials such as lignin as an energy source. The degradation 1of lignin is extensive throughout the cell walls, and may originate from only one or two hyphal filaments. The degradation of lignin and the softening of the cell walls confer positive benefits in subsequent pulping procedures. Wood degradation by white-rot fungi is influenced by the amount and type of lignin present in the wood. Different species of trees have different types and concentrations of the two main lignin types. As a result, a particular white-rot fungi may degrade some species of woods better than other species of wood.

In the biopulping process, virgin wood is mechanically reduced to wood chips. These wood chips are inoculated with a nutrient medium and a white-rot fungus. The inoculated chips are ventilated at an appropriate temperature and humidity to allow fungal growth. After a period of about one to four weeks, the chips are harvested and used in pulping processes. The use of these fungal treated chips in refiner mechanical pulping has resulted in substantial energy savings and produced paper with increased burst and tear strength. U.S. Pat. 5,055,159 (Blanchett, et al.) discloses a method of biopulping using a white-rot fungus. *Ceriporiopsis subvermispora* was found to confer the greatest energy savings for mechanical pulping. U.S. Pat. 5,620,564

(Akhtar) discloses a method of treating wood chips with a nutrient adjuvant at the same time as inoculation with *C. subvermispora*. Treatment of the substrate wood chips with a nutrient greatly reduces the amount of fungus needed to inoculate the wood chips. U.S. Pat. 5,460,697 (Akhtar, et al.) discloses a method of sterilizing-wood chips with a sulfite salt which allows growth of white-rot fungi. These patents are incorporated by reference.

Industrial wood waste has found little use in paper production for several reasons. First, contaminating material may be damaging to paper mill machinery. As a result, industrial wood waste must be cleaned before it can be passed through a paper mill. Second, industrial wood waste is a non-uniform material, consisting of a mixture of species of wood. Third, pulping of wood waste generally results in pulp characterized by short fiber length, which results in paper with poor strength qualities. As a result, pulp resulting from wood waste must be mixed with pulp produced from virgin timber.

Industrial wood waste represents a vast untapped source of wood fiber for the production of paper. However, industrial wood waste has not been utilized as a major source of wood fiber.

SUMMARY OF THE INVENTION

According to one aspect of the invention, there is a method of producing paper. The method begins with industrial wood waste chips. The chips are hydrated, preferably by soaking the chips in water, spraying the chips with waiter, or by application of steam, so that the moisture content of the chips is about 50 to 65%. The chips are then decontaminated, preferably by the transient application of steam. The hydrating step and the decontaminating step may therefore be accomplished at the same time by the application of steam. The chips are then inoculated with a lignin-degrading fungus or fungi, preferably selected from the group of *Phlebia subserialis, Phlebia tremellosa, Dichomitus squalens, Perenniporia medulla-panis, Phlebia brevispora, Hyphodontia setulosa* and *Ceriporiopsis subverrmisporal.* Preferably, a nutrient solution is applied at the same time as the lignin-degrading fungus or fungi. The inoculated chips are then incubated under conditions favorable to the propagation of the fungus throughout the chips. The chips are harvested after the lignin has been sufficiently degraded, and then pulped by mechanical means, preferably by mechanical pulping, alkaline peroxide refiner mechanical pulping, or thermomechanical pulping or chemical means such as kraft pulping. The pulp so produced is then made into paper.

According to another aspect of the invention, there is a method of producing pulp. The method begins with industrial wood waste chips. The chips are hydrated, preferably by soaking the chips in water, spraying the chips with water, or by application of steam, so that the moisture content of the chips is about 50 to 65w. The chips are then decontaminated, preferably by the transient application of steam. The hydrating step and the decontaminating step may therefore be accomplished at the same time by the application of steam. The chips are then inoculated with a lignin-degrading fungus or fungi, preferably selected from the group of *Phlebia subserialis, Phlebia tremellosa, Dichomitus squalens, Perenniporia medulla-panis, Phlebia brevispora, Hyphodontia setulosa* and *Ceriporiopsis subvermispora.* Preferably, a nutrient solution is applied at the same time as the lignin-degrading fungus or fungi. The inoculated chips are then incubated under conditions favorable to the propagation of the fungus throughout the chips. The chips are harvested after the lignin has been sufficiently degraded, and then pulped by mechanical means, preferably by mechanical pulping, alkaline peroxide refiner mechanical pulping, or thermomechanical pulping or chemical means such as kraft pulping.

According to another aspect of the invention, there is a method of producing chips suitable for pulping. The method begins with industrial wood waste chips. The chips are hydrated, preferably by soaking the chips in water, spraying the chips with water, or by application of steam, so that the moisture content of the chips is about 50 to 65%. The chips are then decontaminated, preferably by the transient application of steam. The hydrating step and the decontaminating step may therefore be accomplished at the same time by the application of steam. The chips are then inoculated with a lignin-degrading fungi, preferably selected from the group of *Phlebia subserialis, Phlebia tremellosa, Dichomitus squalens, Perenniporia medulla-panis, Phlebia brevispora, Hyphodontia setulosa* and *Ceriporiopsis subvermispora.* Preferably, a nutrient solution is applied at the same time as the lignin-degrading fungus or fungi. The inoculated chips are then incubated under conditions favorable to the propagation of the fungus throughout the chips. The chips are harvested after the lignin has been sufficiently degraded.

According to another aspect of the invention, there is composition of matter comprising hydrated industrial wood waste chips impregnated with a lignin-degrading fungus or fungi.

It is apparent that the processes and wood chips of the present invention provide a new use for industrial wood waste, provide for the production of paper with superior strength as compared to paper produced from industrial wood waste that has not been biopulped, and provide for substantial energy savings during mechanical pulping. Accordingly, it is an object of the present invention to provide a method for producing paper from industrial wood waste chips having high strength and which saves significant amounts of energy during mechanical pulping. It is also an object of the present invention to provide industrial wood waste chips which are impregnated with a lignin degrading fungus, the chips being suitable for use in pulping and the subsequent production of paper.

DETAILED DESCRIPTION

The present invention is directed towards the biopulping of industrial wood waste. The biopulping process has been the subject of several recent patents, as set forth above.

Industrial wood waste is a relatively unutilized source of fiber for paper making. Industrial wood waste includes kiln dried, air dried and green wood derived from industrial applications such as crates, pallets, mill works, construction, landscaping and demolition. Industrial wood waste has been utilized mainly for mulching, animal bedding, and as hog fuel for power plant boilers. More recently, industrial wood waste has been used in the production of corrugated medium, liner board, fiber board and newsprint.

In the process of the current invention, the industrial wood waste must first be cleaned of contaminated materials including rocks, metals and other foreign materials. Any combination of steps for removing contaminating material may be used. The steps may be varied or additional steps added to effect the purpose of removal of damaging contaminating material. The first step is sorting the wood waste into various roll-off boxes at the site of its production. Mill waste and construction waste are generally clean and may need little further sorting. Demolition waste and other wood waste from objects built from or utilizing wood generally require further sorting. The next step is the sorting of highly contaminated material by hand. The sorted materials are then ground or chipped using standard grinding or chipping equipment, such as a tub grinder, to produce a relatively uniform product consisting of small wood chips. These chips are then screened by use of trommel with a ⅛ inch screen size to screen out fines. The wood chips are next passed over a conveyor belt and ferrous material removed with an electromagnet. The wood chips are then passed over shaker screens of increasing screen size to remove different size chips. For exceptionally contaminated material, it may be necessary to wash the chips and to allow contaminating material to settle out.

Mixtures of wood chips derived from various species of wood may be used in the biopulping process of the present invention. One possible limitation of utilization of industrial wood waste for paper making is non-uniformity of the material. Industrial waste wood is a mixture of hard and soft woods, and this mixture will vary with each batch of wood processed. Different species of wood have different lignin compounds. White-rot fungi are known to exhibit species specific preferences for various lignin substrates. Some white-rot fungi such as *C. subvermispora* are known to be effective in several different species of wood. However, it would not be expected that one species of fungus would be sufficient for effective treatment of a wide variety of woods. Results of experiments set forth in the Examples demonstrate that wood species variability did not effect the efficiency of biopulping. Moreover, several species of white-rot fungi are effective for biopulping wood waste comprising any combination of wood species.

The next step in the process is the hydration of the chips. Dried industrial wood waste has a moisture content of about 10%. Preferably, the moisture content of the wood chips is increased to about 50–60% on a wet weight basis, most preferably to about 55% on wet weight basis. Hydration of the chips may be accomplished by many methods including spraying the chips with water, soaking the chips in water, steam treatment of the chips, and the like.

After inoculation with white rot fungi the hyphae of white rot fungi may penetrate the dry wood matrix of industrial wood chips. During decay of virgin wood by white-rot fungi, fungal mycelia enter the cell lumina, producing fine penetrating hyphae that enter the secondary cell wall. Upon penetration of the lumen, the fungi first derives energy from easily assimilated nutrients, followed by degradation of lignin and other cell wall components. White-rot fungi that selectively degrade lignin produce hyphae that degrade lignin progressively from the lumen edge of the secondary cell wall toward the middle lamella. Penetration of the dry wood matrix of kiln or air dried industrial wood waste was surprising in that this matrix lacks nutrient substrates in a form readily accessible to the fungus. The availability of these nutrients has been thought necessary for propagation throughout the wood chip, and for subsequent cell wall softening.

Prior to inoculation, the wood chips are heat treated to reduce the population of naturally occurring microorganisms which inhibit growth of the white-rot fungi either directly or competitively. Several methods of decontaminating the wood chips have been described. U.S. Pat. No. 5,460,697, incorporated herein by reference, describes a method of treating wood chips with sulfite salts at concentrations that do not inhibit the growth of certain strains of white-rot fungi. Methyl bromide may also be used to treat wood chips as described by Lamar, et al., *Appl. Environ. Microb.,* 56:3093–3100, 1990. The preferred method of decontaminating the chips is by exposure to steam. Most preferably, the chips are exposed to atmospheric steam for a period sufficient to disable native organisms but not so long as to sterilize the chip surfaces. In commercial use the chips may be passed over a conveyor belt or conveyed through an auger fitted with a steam manifold for transient exposure to steam. This step may be combined with or performed simultaneously with the hydration step to produce chips with about an overall 50–60w moisture content on a wet weight basis. These chips have this moisture content on a volume basis, although moisture content internal of the chips is much less.

The sterilized chips are then inoculated with white-rot fungus, which is chosen to selectively degrade lignin. Most preferably the white-rot fungus is selected from the group of *Phlebia subserialis, Phlebia tremellosa, Dichomitus squalens, Perenniporia medulla-panis, Phlebia brevispora, Hyphodontia setulosa* and *Ceriporiopsis subvermispora.* The chips, may be inoculated with one or a combination of fungi, and a nutrient selected from the group of corn steep liquor, molasses and yeast extract. Use of a nutrient adjuvant greatly reduces the amount of fungus required to inoculate the wood chips (about 1–8 g of fungus/ton chips). When nutrient adjuvant is used, it should be added to the chips prior to addition of the fungus.

Fungus may be prepared for inoculation as follows. One-liter flasks containing 24 g potato dextrose broth (Difco Laboratories, Detroit, Mich.) and 7.27 g yeast extract (Amberex 1003, Universal Foods Corporation, Milwaukee, Wis.) are autoclaved for 20 min. at 121° C. and 15 psi, cooled and inoculated with 10 plugs cut with a 9 mm diameter cork bore from 10-day old PDA plate cultures. The flasks are incubated at 27±1° C. and 65±5% relative humidity for 10 days without agitation. The spent medium from the cultures is decanted, the mycelial mats washed with sterile water, and the mats aseptically blended in a Waring blender. Sterile water is added in sufficient quantity to the blended mycelium to make the mycelial suspension stock. Fungus production on an industrial level can be scaled up appropriately using large fermentors and scale up methods known in the art.

General parameters of inoculation are disclosed in U.S. Pat. Nos. 5,620,564 and 5,620,564, hereby incorporated by reference. Fungus may be applied to the wood chips in many ways, including as a liquid or solid inocula. Preferably a starter inoculum may be prepared. The starter inocula may be a smaller volume of wood chips carrying the fungi that can be mixed with a larger volume of chips to be biopulped. The fungal inocula or starter inocula and the nutrient adjuvant are preferably added at the same time. Generally, the preferred amount of nutrient adjuvant is about 0.5% to 3.0% on a weight basis as a proportion of the wood chip mixture. When a nutrient adjuvant is used, the preferred amount of fungal inoculant used is about less than 0.3% on a dry weight basis, more preferably about less than 0.01% on a dry weight basis, and most preferably about less than 0.0005% on a dry weight basis.

The inoculated chips are introduced to a bioreactor and incubated. U.S. Pat. Nos. 5,055,159 and 5,620,564, incorporated herein by reference, disclose suitable designs for laboratory scale bioreactors. Bioreactors may take many different forms. The reactors may be static or rotating drum type bioreactors. In commercial use; the bioreactor may be simply an industrial scale pile of wood chips aerated by a humidified air source. What is important is that throughout the incubation period sufficient aeration is provided to allow removal of carbon dioxide, the air be conditioned or humidified so that the moisture content of the chips is maintained at about 55–65%, and the temperature be maintained in range conducive to the growth of the fungus strain selected. In the laboratory scale system, it has been found that air flow rates of about 0.022 $11^{-1}min^{-1}$ and about 0.100 $11^{-1}$ $min^{-1}$ produce chips which when pulped had excellent energy savings and strength properties. An air flow rate of 0.001 $11^{-1}min^{-1}$ gave suboptimal results (Akhtar et al., Fungal Delignification and Biomechanical Pulping of Wood, in *Advances in Biochemical Engineering/Biotechnology,* T. Scheper ed., Springer-Verlag, Berlin, 1997, incorporated herein by reference). An appropriate temperature range for most strains of white-rot fungi is about 22 degrees Centigrade to about 32 degrees Centigrade, preferably about 27 degrees Centigrade. The purpose of ventilation is largely to effect heat dissipation so that other means controlling temperature may be used, as by special silos designed to provide a heat sink for temperature control. Preferably, the pH of the chip incubation culture should be monitored and maintained within a broad range of about pH 3.0 to 6.0.

The time period of incubation will vary depending mainly on economic considerations. A longer incubation time leads to greater energy saving previously because chips whose lignin is more completely deepened require less energy to the cellulose fibers. Additionally, the time of incubation will depend in part on the growth rate of the fungus. It is desirable to incubate the chips a period of time sufficient for substantial degradation or big chemical modifications of the lignin present in the wood chips. Generally, an incubation of about one to flour weeks is sufficient for degradation or modification of lignin by the white-rot fungi.

After incubation, the chips are pulped by any standard pulping process known in the art. White-rot fungi treated chips are particularly suitable for refiner mechanical pulping (RMP) because of the large energy saving realized when using fungal treated chips in this process. The chips may also be used in alkaline peroxide refiner mechanical pulping (APRMP), thermomechanical pulping (TMP), chemimechanical pulping (CMP), chemithermomechanical pulping (CTMP), and chemical pulping, particularly the kraft pulping.

The pulps resulting from the pulping processes may then be used to make paper. Paper produced from biopulped virgin wood chips has been proven to have excellent strength properties as measured by burst index and tear index. For a review, see Akhtar et al., Advances in Biochemical Engineering/Biotechnology, Springer-Verlag, Berlin, T. Scheper ed., Vol. 57, pp 159–195, herein incorporated by reference.

Treatment of industrial wood waste chips with white-rot fungi prior to RMP or APRMP also resulted in substantial energy savings. Data set forth in the Examples demonstrate that when industrial wood waste chips are pre,-treated with white-rot fungi energy savings of between 21 and 36 percent are realized as compared to untreated chips. Energy savings depends on the strain of fungus used. These results are comparable to the energy saving associated with fungal treated virgin wood chips.

Industrial wood waste has previously been utilized as paper furnish. However, it has previously been necessary to mix the pulp produced from industrial wood waste with pulp produced from virgin wood because of undesirable fiber length associated with the industrial wood waste pulp. The wood waste pulp becomes, in effect, a filler for making cheap paper where reduction in strength and quality can be tolerated. The process of the present invention produces paper made entirely from biopulped industrial waste wood with strength characteristics similar to paper produced from virgin wood pulp and much superior to untreated industrial wood waste pulp.

The advantages of the present process invention will become more apparent from the Examples which follow, demonstrating production of paper solely from fungal treated industrial wood waste.

EXAMPLES

The following methods apply to each of the Examples:

Fungi

Fungi were obtained from the culture collection of the Center.for Forest Mycology Research of the USDA Forest. Service, Forest Products Laboratory, Madison, Wis. Cultures were maintained on potato dextrose agar (PDA) (Difco Laboratories, Detroit, Mich.) slants at 4° C. until used. PDA plate cultures were inoculated from these slants and incubated at 27±5% relative humidity for 10 days.

Inoculum Preparation

The culture medium (1-liter) contained 24 g potato dextrose broth (Difco Laboratories, Detroit, Mich.) and 7.27 g yeast extract (Amberex 1003, Universal Foods Corporation, Milwaukee, Wis.). Ten flasks (1-liter) each containing 100 ml of medium were autoclaved for 20 min. at 121° C. and 15 psi, cooled, and inoculated with 10 plugs cut with a 9 mm diameter cork bore from 10-day old, PDA plate cultures. The flasks were incubated at 27±1° C. and 65±5% relative humidity for 10 days without agitation. The spent medium from ten cultures was decanted, the mycelial mats washed with sterile water, and aseptically blended in a Waring blender. Sterile water was added in sufficient quantity to the blended mycelium to make the mycelial suspension stock.

Corn Steep Liquor

Corn steep liquor was obtained form CPC International Inc., Argo, Ill. and was stored at 4° C.

Chip Preparation and Bioreactor Inoculation

Thawed chips were mixed thoroughly and placed in static-bed bioreactors. These were steamed (without pressure) for about 10 minutes. The bioreactors (at room temperature) each containing 1500 g chips (on dry weight basis) were then inoculated with fungi and corn steep liquor. Corn steep liquor was added to the mycelial suspension prior to inoculation. Bioreactors containing non-inoculated chips served as controls. The final water content of the chips was adjusted to 55% (on wet weight basis) with sterile water.

The bioreactors were then sealed, shaken vigorously, and incubated at 27±1° C. for 14 or 28 days. Each bioreactor received a continuous supply of humidified air at the rate of 0.02 volume/volume/min.

Electrical Energy Measurement

At harvest, the untreated control chips and the fungus-treated chips were fiberized in a Sprout-Waldron Model D 2202 single rotating 300 mm diam. disk atmospheric refiner. Energy consumed during fiberization and refining was measured using an Ohio Semitornic Model WH 30-11195 integrating Watt meter attached to the power supply side of the 44.8 kW electric motor. Energy consumption values of fiberizing and refining are reported as W.h/kg chips (oven dry weight basis), with the idle energy subtracted. Idle energy was measured without the chip or pulp load. Chips were fed into the preheated refiner, and the feed rate was adjusted to keep the load between 6 kW and 15 kW.

The initial refiner plate setting was 0.46 mm for fiberization and then clearance was reduced to 0.12, 0.10, 0.09, 0.08, 0.06, 0.05, 0.04, 0.03, 0.01 for refining. At each pass, the pulp was collected as it exited the refiner as a hot water slurry. After each pass, the pulp was stored for at least 30 minutes in the slurry at about 2% consistency to remove latency. Between passes, the pulp slurry was dewatered to about 25% solids content (refining consistency) in a porous bag with pressing. Dilution water (80° C.) was then added each time as the pulp was fed into the refiner. Samples of the pulp slurry were taken and tested for the Canadian Standard Freeness (CSF) at the 0.12 mm plate setting and smaller, and the sampling continued until the CSF of the pulp dropped below 100 ml. CSF is an arbitrary measure of water drainage.

Paper Strength Measurements

Paper hand sheets were made by a standard test technique, TAPPI Standard T205 method. The bursting index of the hand sheets were then measured by the TAPPI Standard T403 method. The internal tearing resistance of the, paper was then measured using the TAPPI Standard T414 technique.

Composition of Wood Species

Batch 1 50% hardwoods+50% softwoods

Hardwoods: Mixture of dense hardwoods

Softwoods: Mixture of different species

Batch 2 80% pine and fir (softwoods)+20% oak (hardwood)

Kraft Pulping

The wood waste, fungus pretreated wood waste, virgin aspen and loblolly pine chips were cooked using a liquor consisting of 20% active alkalinity and 25% sulfidity. The liquor to chips ratio was 4:1. The cooking was done at 171° C. for period of 60–75 min. After cooking, pulp was washed with 90° water to prevent separated lignin from condensing on the fiber surface. Pulp was hot-water defibrated for 5000 revolutions in a British disintegrator. The disintegrated pulp was washed by filtration. Pulp was screened through a laboratory flat screen with 0.203 mm wide slots. Canadian standard freeness (CSF), a measure of water drainage, of screened pulp ranged from 600 to 650 mL. Handsheets were made, and mechanical and optical properties were measured according to TAPPI standard methods.

Example 1

The energy requirements and savings resulting from biomechanical pulping of industrial wood waste with different white-rot fungi were determined. The industrial wood waste chips were inoculated with fungus and 0.5% corn steep liquor on a dry weight basis and incubated for 4 weeks at 27° C. The results are presented in Table 1. seven different white-rot fungi species were examined. Energy saving as compared to an untreated control varied with the species of fungus used for biopulping. In each instance, biopulping resulted in significant energy savings.

TABLE 1

Electrical energy requirements and savings from biomechanical pulping of industrial wood waste with different white-rot fungi

| Fungi | Electrical energy required (wt. h/kg dry wt. of chips) | Energy savings over the untreated control (%) |
|---|---|---|
| Control | 1482 | — |
| *Perenniporia medulla-panis* | 1166 | 21 |
| *Phlebia subserialis* | 1125 | 24 |

TABLE 1-continued

Electrical energy requirements and savings from biomechanical pulping of industrial wood waste with different white-rot fungi

| Fungi | Electrical energy required (wt. h/kg dry wt. of chips) | Energy savings over the untreated control (%) |
|---|---|---|
| *Phlebia brevispora* | 1084 | 27 |
| *Hyphodontia setulosa* | 1055 | 29 |
| *Phlebia tremellosa* | 1007 | 32 |
| *Dichomitus squalens* | 987 | 33 |
| *Ceriporiopsis subvermispora* | 945 | 36 |

Inoculum: 5 g dry weight of fungus per ton of dry wood
Unsterilized corn steep liquor: 0.5% (dry weight basis)
Incubation temperature: 27° C.
Incubation period: 4 weeks

Example 2

The strength properties of paper produced from biomechanical pulping of industrial wood waste with selected white-rot fungi were analyzed. Batch 1 industrial wood waste chips were inoculated with fungus and 0.5% corn steep liquor on a dry weight basis and incubated for 4 weeks at 27° C. The results are presented in Tables 2a and 2b. Four different white-rot fungi species were examined. Tables 2a summarizes the data in terms of absolute numbers, while Table 2b provides a percentage comparison. Biopulping resulted in paper with increased burst and tear indexes. Increases in strength were similar across species.

TABLE 2a

Strength properties (absolute numbers) from biomechanical pulping of industrial wood waste with selected white-rot fungi
BATCH 1

| Fungi | Strength properties | | |
|---|---|---|---|
| | Burst index (kN/g) | Tear Index ($mNm^2/g$) | Tensile Index (Nm/g) |
| control | 0.51 | 1.51 | 15.1 |
| *Phlebia subserialis* | 0.57 | 1.95 | 15.5 |
| *Phlebia tremellosa* | 0.56 | 2.04 | 16.1 |
| *Dichomitus squalens* | 0.52 | 2.01 | 15.8 |
| *Ceriporiopsis subvermispora* | 0.63 | 2.22 | 17.6 |

Inoculum: 5 g dry weight of fungus per ton of dry wood
Unsterilized corn steep liquor: 0.5% (dry weight basis)
Incubation temperature: 27° C.
Incubation period: 4 weeks TABLE 2b Strength properties (absolute numbers) from biomechanical pulping of industrial wood waste with selected white-rot fungi
BATCH 1

| Fungi | Strength improvements over the untreated control (%) Burst index (kN/g) | Tear Index ($mNm^2/g$) | Tensile Index (Nm/g) |
|---|---|---|---|
| *Phlebia subserialis* | 12 | 29 | 3 |
| *Phlebia tremellosa* | 10 | 35 | 7 |
| *Dichomitus squalens* | 2 | 33 | 5 |
| *Ceriporiopsis subvermispora* | 24 | 47 | 17 |

Inoculum: 5 g dry weight of fungus per ton of dry wood
Unsterilized corn steep liquor: 0.5% (dry weight basis)
Incubation temperature: 27° C.
Incubation period: 4 weeks

Example 3

The strength properties of paper produced by alkaline peroxide refiner mechanical pulping (APRMP) of biopulped industrial wood waste were analyzed. Batch 1 industrial wood waste chips were inoculated with *Ceriporiopsis subvermispora* and 0.5% corn steep liquor on a dry weight basis and incubated for 4 weeks at 27° C. After biopulping, chips were steamed (10 min. 138 kPa) and then stirred in a solution containing 2% NaOH and 3% $H_2O_2$ for 30 min. at atmospheric pressure. Excess solution was drained from the chips prior to refining. The results are presented in Tables 3a and 3b. Tables 3a summarizes the data in terms of absolute numbers, while Table 3b provides a percentage comparison. Paper produced by AMRMP after fungal treatment had significantly increased strength as compared to paper produced from untreated chips pulped by either RMP or APRMP.

TABLE 3a

Strength properties (absolute numbers) due to alkaline peroxide refiner mechanical pulping (APRMP) of control and *Ceriporiopsis subvermispora*-treated industrial wood waste over refiner mechanical pulping (RMP) of control industrial wood waste
BATCH 1

| Parameters | Values |
|---|---|
| Burst index (kN/g)-control (RMP) | 0.51 |
| Burst index (kN/g)control (APRMP) | 0.65 |
| Burst index (kN/g)-fungus-treated (APRMP) | 0.85 |
| Tear index ($mNm^2/kg$)-control (RMP) | 1.51 |
| Tear index ($mNm^2/kg$)-control (APRMP) | 2.08 |
| Tear index ($mNm^2/kg$)-fungus-treated (APRMP) | 2.98 |
| Tensile index (Nm/g)-control (RMP) | 15.1 |
| Tensile index (Nm/g)-control (APRMP) | 15.1 |
| Tensile index (Nm/g)-fungus-treated (APRMP) | 22.5 |

TABLE 3b

Strength properties (improvements) due to alkaline peroxide refiner mechanical pulping (APRMP) of control and *Ceriporiopsis subvermispora*-treated industrial wood waste over refiner mechanical pulping (RMP) of control industrial wood waste
BATCH 1

| Parameters improvement over RMP control values | % |
|---|---|
| Burst index (kN/g)-control (APRMP) | 27 |
| Burst index (kN/g)-fungus-treated (APRMP) | 67 |
| Tear index ($mNm^2/kg$)-control (APRMP) | 38 |
| Tear index ($mNm^2/kg$)-fungus-treated (APRMP) | 97 |
| Tensile index (Nm/g)-control (APRMP) | 23 |
| Tensile index (Nm/g)-fungus-treated (APRMP) | 49 |

Example 4

The energy requirements for biomechanical pulping of industrial wood waste and strength properties of paper produced from biopulped industrial wood waste were compared to energy requirements for virgin wood pulping and strength properties of paper produced from virgin wood. Batch 1 industrial wood waste chips were inoculated with *Ceriporiopsis subvermispora* and 0.5% corn steep liquor on a dry weight basis and incubated for 4 weeks at 27° C. The data is summarized in Table 4. Fungal treatment resulted in significant energy saving as compared to both control industrial waste chips and virgin chips, and the paper produced following fungal treatment had superior strength characteristics as compared to both control industrial wood waste chips and virgin chips.

TABLE 4

Comparison of control and *Ceriporiopsis subvermispora*-treated industrial wood waste with control virgin wood (loblolly pine-softwood)
BATCH 1

| Parameters | Industrial wood waste control | Industrial wood waste fungus-treated | Virgin Wood loblolly pine |
|---|---|---|---|
| Electrical energy requirement (wt.h/kgo.d.chips) | 1482 | 945 | 1526 |
| Burst index (kN/g) | 0.51 | 0.63 | 0.58 |
| Tear index ($mNm^2/kg$) | 1.51 | 2.22 | 1.80 |
| Tensile index (Nm/g) | 15.1 | 17.6 | 16.6 |

Example 5

The energy requirements for biomechanical pulping of industrial wood waste and strength properties of paper produced from biopulped industrial wood waste for Batch 2 wood were determined. Batch 2 industrial wood waste chips were inoculated with *Ceriporiopsis subvermispora* and 0.5% corn steep liquor on a dry weight basis and incubated for 4 weeks at 27° C. The data is summarized in Table 5. Fungal treatment resulted in significant energy saving as compared to control industrial waste chips, and the paper produced following fungal treatment had superior strength characteristics as compared to both control industrial wood waste chips. Increasing the moisture content of the industrial wood waste chips alone was not enough to confer substantial benefits in energy saving or paper strength, incubation with fungus was required.

TABLE 5

Biopulping of industrial wood waste with *Ceriporiopsis subvermispora* BATCH 2

| Treatments | Energy Savings (%) | Burst Index (kN/g) | Tear Index ($mNm^2/g$) | Tensile Index (Nm/g) |
|---|---|---|---|---|
| Dry Control | — | 0.49 | 2.21 | 14.4 |
| Steamed control | — | 0.60 | 2.65 | 17.1 |
| 2-week fungus-treated chips | 10 | 0.66 | 2.94 | 19.0 |
| 4-week fungus-treated chips | 30 | 0.81 | 3.05 | 23.3 |

Inoculum: 5 g dry weight of fungus per ton of dry wood
Unsterilized corn steep liquor: 0.5% (dry weight basis)
Incubation temperature: 27° C.
Incubation period: 2 and 4 weeks

Example 6

Kraft pulp of industrial wood waste was prepared and the mechanical and optical properties were compared with those of virgin pulp from aspen and loblolly pine. The comparative results are shown in Table 6a. Loblolly pine is the main wood species used as Kraft pulping raw material in the United States. The mechanical properties of wood waste Kraft pulp were very much similar to those of Kraft pulp from loblolly pine. The characteristics of wood waste pulp are far superior to those of aspen Kraft pulps. Mechanical properties of wood waste (control) and fungus-treated wood waste kraft pulp are presented in Table 6b. Industrial wood waste chips were inoculated with *Ceriporiopsis subvermispora* and 0.5% corn steep liquor on a dry weight basis and incubated for 2 weeks at 27° C. Fungal treatment of wood waste resulted in significant increase in kraft pulp properties compared to control wood waste pulp.

TABLE 6a

Kraft pulping of industrial wood waste (control - not treated with fungus) and comparison of physical and optical properties with those of virgin pulps.

| Sample | Brightness (%) | Burst Index (kN/g) | Tear Index ($mNm^2/g$) | Tensile Index (Nm/g) |
|---|---|---|---|---|
| Wood waste (control) | 85.7 | 6.0 | 10.5 | 80.5 |
| Aspen | 87.7 | 4.00 | 5.7 | 68.0 |
| Loblolly pine | 82.4 | 6.00 | 13.5 | 75.0 |

TABLE 6b

Kraft pulping of industrial wood waste (control) and fungus-treated wood waste and the comparison of pulp properties.

| Sample | Burst Index (kN/g) | Tear Index ($mNm^2/g$) | Tensile Index (Nm/g) |
|---|---|---|---|
| Wood waste (control) | 6.0 | 10.5 | 80.5 |

TABLE 6b-continued

Kraft pulping of industrial wood waste (control) and fungus-treated wood waste and the comparison of pulp properties.

| Sample | Burst Index (kN/g) | Tear Index ($mNm^2/g$) | Tensile Index (Nm/g) |
|---|---|---|---|
| Wood waste (fungus-treated) | 6.2 | 11.2 | 82.8 |

Inoculum: 5 g dry weight of fungus per ton of dry wood basis
Unsterilized corn steep liquor: 0.5% (dry weight basis)
Incubation temperature: 27° C.
Incubation period: 2 weeks

What is claimed is:

1. A method for producing paper from industrial wood waste chips, said method comprising:

a) providing industrial wood waste chips, wherein the chips are derived from various species of wood;

b) hydrating the chips;

c) decontaminating the chips;

d) inoculating the chips with a lignin-degrading fungus selected from the group consisting of *Phlebia subserialis, Phlebia tremellosa, Dichomitus squalens, Perenniporia medulla-panis, Phlebia brevispora, Hyphodontia setulosa* and *Ceriporiopsis subvermispora;* e) incubating the wood chips under conditions favorable to the propagation of the fungus through the wood chips;

f) mechanically pulping the wood chips; and g) making paper with the pulp.

2. The method of claim 1 wherein the hydrating step and the decontamination step are accomplished by the application of steam to the chips sufficient to raise the moisture content of the chips to about 50 to 65%.

3. The method of claim 1 wherein the pulping method is selected from the group of mechanical pulping, alkaline peroxide refiner mechanical pulping, thermomechanical pulping and kraft pulping.

4. The method of claim 1 wherein said inoculation step further comprises applying a nutrient to the chips.

5. A method of pulping industrial wood waste chips, said method comprising:

a) providing industrial wood waste chips, wherein the chips are derived from various species of wood;

b) hydrating the chips;

c) decontaminating the chips;

d) inoculating the chips with a lignin-degrading fungus selected from the group consisting of *Phlebia subserialis, Phlebia tremellosa, Dichomitus squalens, Perenniporia medulla-panis, Phlebia brevispora ,Hyphodontia setulosa* and *Ceriporiopsis subvermispora;* e) incubating the wood chips under conditions favorable to the propagation of the fungus through the wood chips; and f) mechanically pulping the chips.

6. The method of claimed 5 wherein the hydrating step and the decontaminating step are accomplished by the application of steam to the chips sufficient to raise the moisture content of the chips to about 50 to 65%.

7. The method of claim 5 wherein said inoculation step further comprises applying a nutrient to the chips.

8. The method of claim 5 wherein the pulping method is selected from the group of mechanical pulping, alkaline peroxide refiner mechanical pulping, thermomechanical pulping and kraft pulping.

9. A method of pretreating industrial wood waste chips for use in pulping, said method comprising:

a) providing industrial wood waste chips, wherein the chips are derived from various species of wood;

b) hydrating the chips;

c) decontaminating the chips;

d) inoculating the chips with a lignin-degrading fungus selected from the group consisting of *Phlebia subserialis, Phlebia tremellosa, Dichomitus squalens, Perenniporia medulla-panis, Phlebia brevispora, Hyphodontia setulosa* and *Ceriporiopsis subvermispora;* and e) incubating the wood chips under conditions favorable to the propagation of the fungus through the wood chips.

10. The method of claim 9 wherein the hydrating step and the decontaminating step are accomplished by the application of steam to the chips sufficient to raise the moisture content of the chips to about 50 to 65%.

11. The method of claim 9 wherein said inoculation step further comprises applying a nutrient to the chips.

12. A method for producing paper from industrial wood waste, said method comprising:

a) removing contaminating materials from industrial wood waste, wherein the industrial wood waste is derived from various species of wood;

b) chipping the industrial wood waste to form chips;

c) sterilizing the chips by applying steam so that the moisture level of the chips is increased to about 55 to 65 percent;

d) introducing the chips into a bioreactor;

e) inoculating the chips with corn steep liquor and a lignin-degrading fungi selected from the group of *Phlebia subserialis, Phlebia tremellosa, Dichomitus squalens, Perenniporia medulla-panis, Phlebia brevispora, Hyphodontia setulosa* and *Ceriporiopsis subvermispora;* f) incubating the wood chips under conditions favorable to the propagation of the selected fungus through the wood chips;

g) pulping the wood chips by a pulping method selected from the group of mechanical pulping, alkaline peroxide refiner mechanical pulping and kraft pulping so that a selected level of freeness of fibers in the pulp is obtained; and h) making paper with the pulp.

13. A method of pretreating industrial wood waste for pulping, said method comprising:

a) removing contaminating materials from industrial wood waste, wherein the industrial wood waste is derived from various species of wood;

b) chipping the industrial wood waste to form chips;

c) sterilizing the chips by applying steam so that the moisture level of the chips is increased to about 50 to 65 percent;

d) introducing the chips into a bioreactor;

e) inoculating the chips with corn steep liquor and a lignin-degrading fungi selected from the group of *Phlebia subserialis, Phlebia tremellosa, Dichomitus squalens, Perenniporia medulla-panis, Phlebia brevispora, Hyphodontia setulosa* and *Ceriporiopsis subvermispora;* and f) incubating the wood chips under conditions favorable to the propagation of the selected fungus through the wood chips.

* * * * *